US006571518B1

(12) United States Patent
Barley

(10) Patent No.: US 6,571,518 B1
(45) Date of Patent: Jun. 3, 2003

(54) GROUND ANCHORAGE

(76) Inventor: Anthony Donald Barley, High View, Harlow Pines, Harrogate, Yorkshire HG3 1PZ (GB)

( * ) Notice: Subject to any disclaimer, the term of this patent is extended or adjusted under 35 U.S.C. 154(b) by 0 days.

(21) Appl. No.: 09/762,342

(22) PCT Filed: Aug. 6, 1999

(86) PCT No.: PCT/GB99/02587

§ 371 (c)(1),
(2), (4) Date: May 7, 2001

(87) PCT Pub. No.: WO00/08264

PCT Pub. Date: Feb. 17, 2000

(30) Foreign Application Priority Data

Aug. 6, 1998 (GB) ..... 9817186

(51) Int. Cl.[7] ..... E02D 5/80; E04C 5/08

(52) U.S. Cl. ..... 52/223.13; 52/223.14; 52/295; 52/156; 405/259.1

(58) Field of Search ..... 52/223.13, 223.14, 52/155, 295, 156; 405/231, 239, 255, 259.5

(56) References Cited

U.S. PATENT DOCUMENTS

| | | | | |
|---|---|---|---|---|
| 4,448,002 A | | 5/1984 | Rehm et al. | 52/223 L |
| 4,449,855 A | * | 5/1984 | Langwadt | |
| 4,640,068 A | * | 2/1987 | Jungwirth et al. | |
| 4,671,034 A | * | 6/1987 | Rehm et al. | |
| 4,819,393 A | * | 4/1989 | Augoyard | |
| 5,289,626 A | * | 3/1994 | Mochida et al. | |
| 5,580,642 A | * | 12/1996 | Okamoto et al. | |
| 5,809,710 A | * | 9/1998 | Jungwirth et al. | |

FOREIGN PATENT DOCUMENTS

| | | | |
|---|---|---|---|
| DE | 342167 | | 10/1921 |
| EP | 0807717 | | 11/1997 |
| GB | 2223518 | | 4/1990 |
| GB | 2260999 | * | 5/1993 |
| JP | 5-33336 | | 6/1993 |
| JP | 06307021 | | 11/1994 |

OTHER PUBLICATIONS

"Soil Nail Case Histories and Developments"—Barley, ICE Conference on Retaining Structures Cambridge, Jul. 1992.
"Summary of Keller/Colcrete Investigation Work" Barley Dec., 1991, pp. 3 and 4.
"Weldgrip Fibregrip Rockbolts"—Weldgrip Mining Division Nov. 1996.
"Trial Soil Nails for Tunnel Face Support" Barley and Graham Conference, London Jun. 3–5, 1997.
"Weld Grip Limited"—Report on Weldgrip Fibreglass Bolt Installation and Pullout Tests, M25 Road Widening, Junctions 8 to 9" Holt Oct. 1996.

* cited by examiner

*Primary Examiner*—Robert Canfield
(74) *Attorney, Agent, or Firm*—MacMillan, Sobanski & Todd, LLC

(57) ABSTRACT

The present invention provides a single bore multiple anchorage in which a plurality of unit anchorages (2, 4) are contained in a single bore, the unit anchorages (2, 4) each comprising a tendon (12, 14) having a bond length bonded to the bore grout and a free length, wherein at least one of the tendons comprises a synthetic polymeric material. The ground anchorage means may be made by placing a plurality of unit anchorages in a bore, pouring grout into the bore and stressing each of the tends separately and locking the stressed tendons individually with respect to the anchor head.

1 Claim, 2 Drawing Sheets

GROUND ANCHORAGE

This invention relates to ground anchorages.

A description of the use and construction of ground anchorages is to be found in the Code of Practice for Ground Anchorages—BS8081—published by the British Standards institution. This Code also contains suggested terminology.

A typical ground anchorage comprises a bore in the ground which is filled with grout (the bore grout). Received in the bore is a tendon generally of steel which at its end remote from the open end of the bore is bonded in an encapsulation comprising a corrugated duct filled with resin or cement grout, to protect the tendon against corrosion. The encapsulation is bonded in the bore grout and the tendon has a free length which is greased and sheathed and has substantially no adhesion to the bore grout. The sheath enters into the encapsulation so that the tendon bond length in the encapsulation is somewhat less than the encapsulation length. At its free end the tendon is received in an anchor head, which is stressed against an anchor plate bearing on the ground and the load on the tendon is locked off against the plate.

The above description relates to a ground anchorage comprising a single tendon. Ground anchorages are also known which comprise a number of steel tendons which are bonded in a single encapsulation of elongate form. The ends of the tendons may be arranged in staggered relation within the encapsulation to spread the load along the encapsulation.

GB 2223518 describes a single bore multiple anchorage comprising a plurality of unit anchorages, each having a tendon, the tendons being bonded in respective encapsulations at staggered and spaced positions along the bore.

This arrangement allows each respective unit anchorage to be loaded to the maximum local capacity of the ground. The total capacity of the multiple anchorage is the sum of the capacities of the unit anchorages. It is very important that the free length of each unit anchor has substantially no adhesion to the bore grout. If this were not the case, there would be a tendency for each unit anchor to apply load in an uncontrolled manner through the bore grout to the ground in the region of encapsulations of other unit anchorages which are higher up the bore. If such uncontrolled or unpredictable loading of the bore grout occurs, it will be impossible to load all of the unit anchors to their maximum capacity without risking failure of the grout to ground bond.

In all of this prior art, an encapsulation is used because the tendons are made of steel, the material of choice due to its strength and availability. The encapsulation serves to transmit the load applied to the tendon to the surrounding grout but at the same time protect the bonded length of the tendon from ingress of moisture which would lead to excessive corrosion and failure of the steel tendons.

In practice, the corrosion protected tendons have to be manufactured off site to a high specification, with the bonded length grouted into the encapsulation in the factory.

The present inventor has realised that great flexibility and simplicity can be obtained in a single bore multiple anchorage if tendons made of synthetic polymeric material can be used. In this case, no encapsulation will be required to protect the bond length of the tendon, as it will not be subjected to degradation due to corrosion.

Accordingly, the present invention provides ground anchorage means comprising a bore in the ground filled with bore grout and a plurality of unit anchorages received in the bore. Each unit anchorage comprises a tendon having (a) a bond length which is bonded along the bond length within the bore grout, (b) a free length arranged so that there is substantially no adhesion between the free length and the bore grout, and (c) a gripped length. The bond lengths of the respective unit anchorages are anchored in the bore grout in a staggered and spaced relationship along the bore. At least one of the tendons is of a synthetic material being gripped in the gripped length by a grip arranged to apply compression to the tendon in a direction transverse to the longitudinal direction of the tendon. The compression increases over the gripped length of the tendon in such a manner that, at no point along its length, is the tendon subjected to shear which is greater than the shear strength of the tendon.

Preferably, all of the tendons comprise synthetic polymeric material.

It is surprising that synthetic polymeric material tendons can be used successfully in an anchorage in this way.

The person skilled in the art is aware that the synthetic polymeric material will not bond to the grout as well as steel. This would raise the problem that the bond length of each respective unit anchor would be so long that it would not be practical to accommodate multiples of such unit anchorages in a single borehole. It has been found that suitable surface deformation of the bond length of the polymeric material tendons can result in acceptable bond lengths without substantially reducing the tendon pull out capacity.

Accordingly, to increase the bond of a tendon within the grout, each tendon is preferably profiled deformed on its outer surface within the grout. The surface of the tendon in the bond length be roughened.

Further, the person skilled in the art is aware that polymeric materials which are suitable for manufacturing tendons are very strong in tension but, compared to steel, relatively weak in compression and shear. The person skilled in the art would understand that the gripping arrangements normally provided for steel anchors could not be used with polymeric tendons, as there would be a tendency for the tendons to be crushed by the gripping means. However, the present inventor has discovered that as long as the grip is applied to the tendon in such a manner that compression is applied to the tendon, the compression increasing along the length of the tendon in a manner that, at no point along its length, is the tendon subjected to shear which is greater than the shear strength of the tendon. For example, the gripping force may be spread over a sufficient length and increased in small steps or.at a low rate over a comparatively long length of tendon. Sufficient gripping force can then be applied to the tendon without damaging it and to allow tendon capacities in excess of 50 kN to be achieved.

In particular, the ground anchorage means according to the present invention may comprise gripping means configured to apply compression to the tendon in a direction transverse to the longitudinal direction of the tendon, the compression increasing along the length of the gripped part of the tendon so that at no point is the tendon exposed to a shearing compression which is greater than the compressive shearing strength of the polymeric material. The gripping means may comprise at least two gripping parts for gripping the tendon therebetween, the gripping parts being urged together by a plurality of urging means located at different positions along the gripped length of the tendon.

Preferably, there are at least four, more preferably at least six urging means. Eight urging means have been found to be suitable. The urging means suitably comprise nut and bolt arrangements, for example pairs of nuts and bolts on either side of the tendon.

The bond length of each of the unit anchorages within the bore will be selected depending upon the ground strength, the soil grading and the bond capacity of the grout with the soil/ground at the respective depth.

The tendons may comprise lengths of polymeric fibre, such as nylon of a suitable grade. Most preferably, the tendons comprise composites comprising synthetic polymeric material. For example, they may comprise nylon or kevlar strands embedded in a synthetic resin. Alternatively, they may comprise glass reinforced plastic, or carbon fibre reinforced plastic.

The tendons may be of any suitable shape or any suitable dimensions. The tendons are suitably approximately circular in cross section, preferably having a diameter in the range 10–50 mm. Alternatively, flat cross sections, such as rectangular or elliptical cross sections may be used. Such flat cross sections may have a thickness (minor axis) in the range 3–15 mm and a width (major axis) in the range 20–100 mm. The modulus of the elasticity of the tendon is preferably in the range 50–200 $kN/m^2$. Commonly available tendon materials have moduli of elasticity in the range 50–100 $kN/m^2$.

The strength of the tendons should be high as possible. Preferably, the capacity is at least 50 kN. Typical glass reinforced plastic tendons have a capacity in the range of 50–500 kN. Carbon fibre tendons may have a capacity in the range 2000–3000 kN.

A tendon for use in the present invention may typically comprise a plurality of fibres aligned with the length of the tendon, the fibres being retained in a resin medium. Such tendons are suitably manufactured by a pultrusion process, as is well known to the person skilled in the art. The tendons may be solid or hollow. Hollow tendons may have a central space whose dimensions are in the range 10–30% of the corresponding outside dimensions of the tendon. For example, a 22 mm diameter tendon may have a central hole of diameter 5 mm.

Preferably, the bonding between the bond length and the bore grout is the sole anchoring effect within the bore grout and operates in the absence of any transverse mechanical stop member within the bore grout.

A particular advantage of the invention is that the amount of pre-preparation of the tendons is lower than is required for steel tendons received in grouted encapsulations. The synthetic polymeric tendons may be supplied in straight lengths or wound on to drums or stored in similar ways and inserted into the bore after suitable treatment of the free length. Preferably, however, the synthetic polymeric tendons are not excessively twisted or bent during storage or during placement in the bore, as twisting can expose the tendons to shearing which may damage them.

According to the present invention, there is substantially no adhesion in the free lengths between the bore grout and the tendons. Preferably, there is substantially no friction between the tendons and the bore grout.

The free length is preferably suitably treated to ensure that there is substantially no bond or adhesion and no friction between the free length and the bore grout. For example, it may be lubricated, for example greased, using grease of the type which is known to the person skilled in the art. It may additionally or alternatively be sheathed with plastic material to prevent adhesion to the bore grout.

Portions of tendons adjacent and parallel to bond lengths of adjacent tendons may be surrounded with compression-resistant ducting, for example a tube of rigid material that is strong in a direction transverse to its length.

The force exerted on the grout by the bonding of the tendon acts in a direction to burst the surrounding grout. If the bond length lies in the vicinity of one or more free lengths of adjacent tendons, there may be a problem. Tendons are greased for movement and are not bonded to the bore grout. They accordingly represent regions of weakness in the resisting of the bursting force. This weakness is made worse, if, as is typically the case, the tendons are individually sheathed with one or more layers of synthetic polymeric material covering at least those portions of the tendon near the respective bond length of another tendon. Suitable compression resistant ducting may comprise compression resistant polymeric material or the like.

A similar arrangement is shown in GB 2260999 in relation to a single bore multiple anchorage in which a plurality of metal tendons are held within encapsulations at staggered and spaced positions along the bore.

The ground anchorage means will include an anchor head at the open end of the bore. Each tendon may be received in a separate hole in the head or in a common hole and gripped by gripping means as set out above. The gripping means serves to transfer load from the tendons to the anchor head. The tendons are stressed and locked off in relation to the anchor head preferably separately from one another.

In the method of the invention, each separate tendon may be provided with a respective stressing jack for extending and placing the tendon under load. Each respective stressing jack will extend by a different amount to the other jacks, depending upon the corresponding elastic length of the tendon in the bore. The tendons may be simultaneously loaded to the same load or they may be loaded to different predetermined load.

The invention will now be described in detail by way of example only with reference to the accompanying diagrammatic drawings in which.

Figure 1:
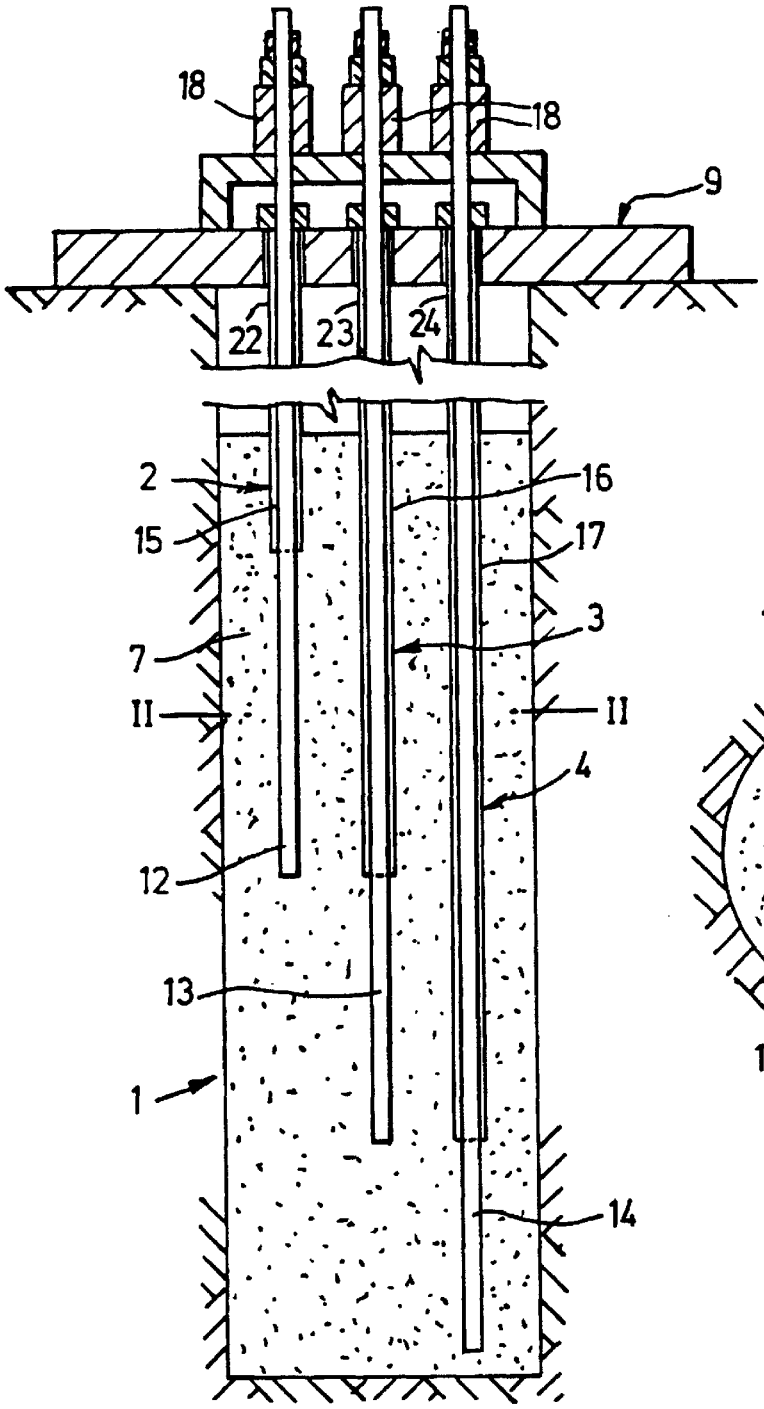
FIG. 1 is a section through ground anchorage means embodying the present invention.
Figure 2:
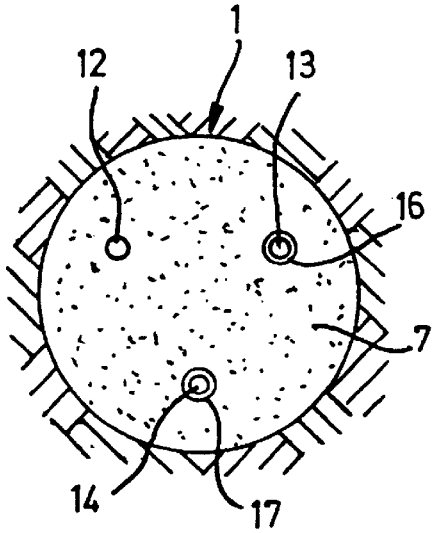
FIG. 2 is a section along line II—II in FIG. 1.

In FIG. 1, the ground anchorage means comprises a bore (1) formed in the ground suitably vertically or at some other desired angle. Within the bore there are three separate ground anchorages (2), (3) and (4). Each comprises a tendon (12), (13), (14), respectively. Each tendon consists of a length of glass reinforced plastic, suitably of circular cross section of diameter 22 mm.

In FIG. 1, the bond length of each tendon (12), (13), and (14), can be seen. The free length of each tendon is lubricated and covered with a plastic sheath, (15), 16 and (17). The bond lengths are bonded to the grout (7) in the bore at different depths. There is substantially no adhesion or friction between the free lengths of each tendon and the grout (7) due to the sheathing and grease (15), (16) and (17).

The tendons may be profiled or shaped so there is good adhesion to the grout (7) in the bond length.

The bond lengths are placed in staggered spaced relationship along the length of the bore (1) so that the load transmitted between each unit anchorage and the ground is exerted over a long overall fixed length or over a multiple of isolated fixed lengths. The multiple of anchorages allows the ground strength to be efficiently used over the depth of the bore and allows a higher load capacity to be obtained than is possible with a normal anchor. Each unit anchorage will pass through a respective hole in an anchor head (9), is gripped by gripping means (18) which will be discussed further below and is stressed with respect to the anchor head (9)separately from the other anchorages and locked-off relative to the head.

Each tendon may be prepared on site by cutting of straight lengths or unreeling a suitable length of glass reinforced plastic from a cable drum and cutting it to the desired length. The free length of each tendon is then lubricated and sheathed. The tendons are then placed into the bore hole and grout is poured into the bore hole, for example using a tremie pipe.

Figure 3:
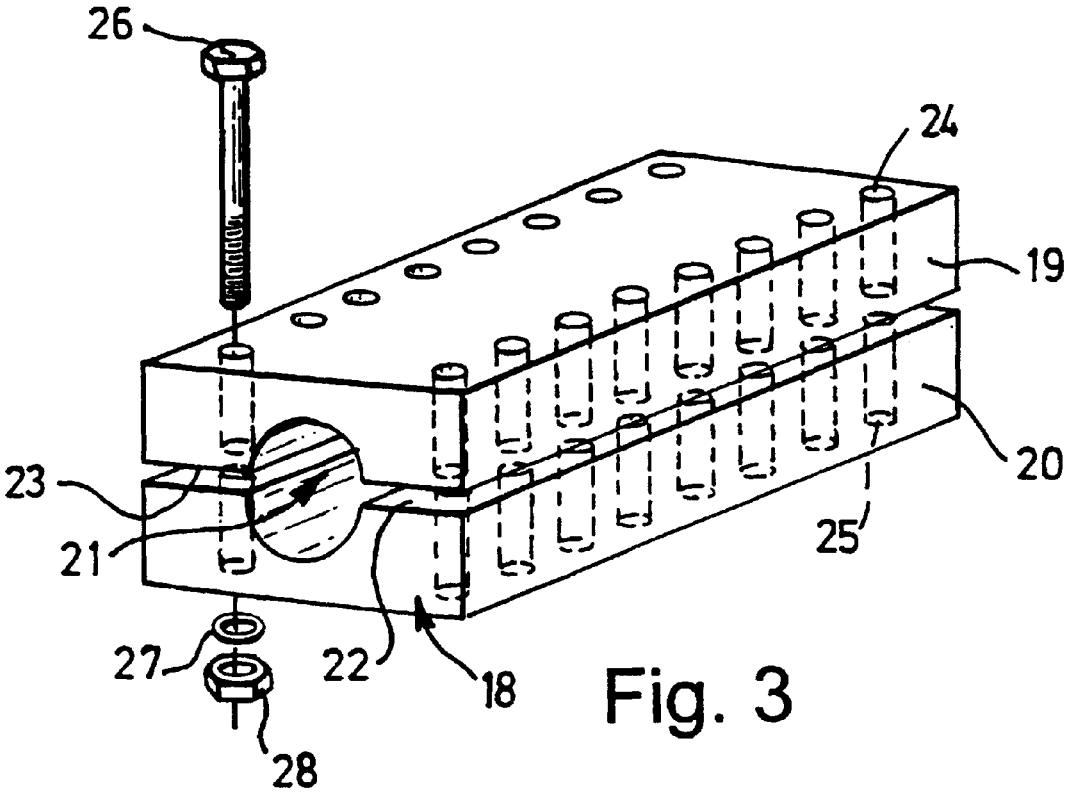
FIGS. 3 and 4 are schematic views of a gripping means.

FIG. 3 shows gripping means (18) used in FIG. 1. The gripping means (18) comprises a pair of gripping parts (19) and (20) which define between them a substantially circular passage (21), of diameter decreasing in the direction away from the borehole, for receiving a tendon. The size of the passage (21) is configured such that, when the tendon is in place, respective facing surfaces (22) and (23) of the gripping parts are spaced apart from one another slightly. The gripping means comprise a plurality of bores (24) and (25). When in position, the bores (24) of one gripping part align with respective bores (25) of the other gripping part (20). The bores (24) and (25) are shown in broken lines in one side of the gripping means (18) in FIG. 3 but are omitted on the other side for clarity. Nut, washer and bolt arrangements (26), (27), (28) are provided, each bolt (26) extending through a pair of bores (24) and (25).

Figure 4:
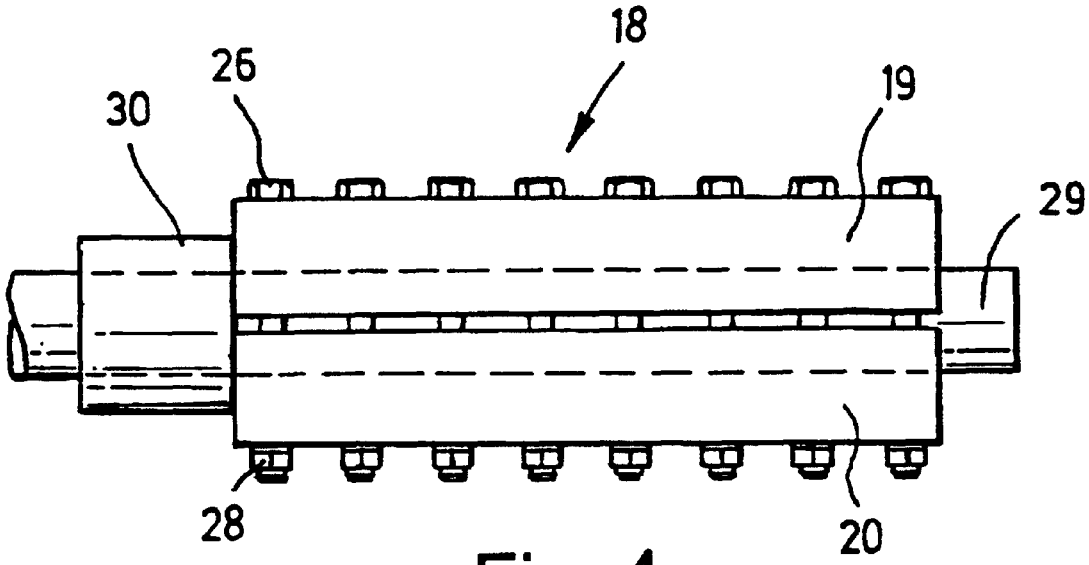

In use, a tendon (29) can be gripped between the gripping parts (19) and (20). A bolt (26) is passed through each pair of bores (24) and (25). The respective nuts (28) are then tightened in a controlled fashion to differing tensions. The tendon (29) shown in FIG. 4 is shown as if it were extending from a bore on the left-hand side of the paper. The grip between the tendon (29) and the gripping means (18) increases from left to right due to the decreasing diameter of the passage (21) and due to the increasing tension to which the nuts and bolts are tightened. The compression exerted by each bolt (26) and nut (28) arrangement is controlled so that at no point is the tendon (29) exposed to a compressive shearing stress which is greater than its shearing strength. (30) denotes the tool of a stressing jack. The stressing jack in use applies tension to the tendon (29) through the gripping means (18) acting in the direction towards the right-hand side of the paper.

The present invention has been described above by way of example only, and modifications can be made within the invention. The invention also consists in any individual features described or implicit herein or shown or implicit in the drawings or any combination of such features or any generalisation of any such features or combination.

What is claimed is:

1. Ground anchorage comprising a bore in the ground filled with bore grout and a plurality of unit anchorages received in the bore, each unit anchorage comprising a tendon having (a) a bond length which is bonded along the bond length within the bore grout, (b) a free length arranged so that there is substantially no adhesion between the free length and the bore grout, and (c) a gripped length;

wherein bond lengths of the respective unit anchorages are anchored in the bore grout in a staggered and spaced relationship along the bore, and wherein at least one of the tendons comprises synthetic polymeric material, the tendon being gripped in the gripped length by a grip arranged to apply compression to the tendon in a direction transverse to the longitudinal direction of the tendon, the compression increasing over the gripped length of the tendon in such a manner that, at no point along its length, is the tendon subjected to shear which is greater than the shear strength of the tendon.

* * * * *